US006213635B1

(12) United States Patent
Savy et al.

(10) Patent No.: US 6,213,635 B1
(45) Date of Patent: Apr. 10, 2001

(54) METHOD FOR MAKING A WATCH CASE

(75) Inventors: Philippe Savy, Montenol; Michael Bach, Biel; Sébastien Bolzt, Moutier; Bertrand Carrard, Bassecourt; Clément Meyrat, Le Landeron, all of (CH)

(73) Assignees: Biwi S.A., Glovelier; Montres Rado SA, Lengnau, both of (CH)

( * ) Notice: Subject to any disclaimer, the term of this patent is extended or adjusted under 35 U.S.C. 154(b) by 0 days.

(21) Appl. No.: 09/403,588

(22) PCT Filed: Feb. 26, 1999

(86) PCT No.: PCT/CH99/00092

§ 371 Date: Oct. 25, 1999

§ 102(e) Date: Oct. 25, 1999

(87) PCT Pub. No.: WO99/44104

PCT Pub. Date: Sep. 2, 1999

(30) Foreign Application Priority Data

Feb. 27, 1998 (CH) ..... 471/98

(51) Int. Cl.[7] ..... G04B 37/00; G04B 39/00

(52) U.S. Cl. ..... 368/299; 291/294

(58) Field of Search ..... 368/276, 294, 368/299, 291

(56) References Cited

U.S. PATENT DOCUMENTS 5,033,035 7/1991 Affolter .

FOREIGN PATENT DOCUMENTS 310877 1/1956 (CH) .
544 960 1/1974 (CH) .
634 454G 2/1983 (CH) .
2 017 168 5/1970 (FR) .
2 463 437 2/1981 (FR) .

*Primary Examiner*—Vit Miska
*Assistant Examiner*—Jeanne Marguerite Goodwin
(74) *Attorney, Agent, or Firm*—Griffin & Szipl, P.C.

(57) ABSTRACT

An element made of elastomeric material (9) is made by overmoulding between the middle part (2) of a watch case and a support ring, in particular a casing ring (3) intended to support the watch movement. This allows the constraints of the inner form and inner machining of the middle part to be reduced, while allowing accurate positioning of the internal elements of the watch with respect to the middle part. The elastomeric element (9) can also assure sealing with the control stem and/or the crystal of the watch.

13 Claims, 2 Drawing Sheets

METHOD FOR MAKING A WATCH CASE

FIELD OF THE INVENTION

The present invention concerns a manufacturing method for a watch case including a middle part, a back cover and a support ring intended to support the internal elements of the watch, wherein the middle part and the support ring are manufactured separately, then the support ring is fixed to the interior of the middle part via a element made of elastomeric material. The invention also concerns a watch case able to be obtained via this method.

BACKGROUND OF THE INVENTION

In the watch and more particularly the wristwatch field, arranging certain elements of the watch such as the movement, the dial or the bezel in a support ring often called the casing ring, which is inserted in the middle part of the watch, is known, as described for example in Swiss Patent No. 681 127.

In the case of a water resistant watch, inserting a plurality of sealing gaskets made of elastomeric material in the vicinity of the back cover, around the stem and watch crystal is known.

Although the machining operations inside the middle part are simplified by the insertion of the casing ring, difficulties remain which have never been satisfactorily resolved. In particular, in order to prevent any angular displacement between the casing ring and the middle part, the latter must, in the prior art, be provided with one or more holes receiving as many catches of the support part or screws in the case of the aforecited document. The problem of the inner dimensions of the middle part, which have to be fitted to the casing ring, thus remains intact.

This problem is particularly acute when the middle part is made of hard materials, for example ceramic materials or hard metal. On the one hand, such parts are generally manufactured by moulding and sintering, thus undergoing dimensional variations which do not allow precise final dimensions to be obtained from the unworked parts. On the other hand, inner machining of these hard parts is very difficult and expensive. In addition to the problem of fitting the casing ring inside the middle part, there is the problem of proper positioning of the ring and thus the clockwork movement, in particular the centring thereof, with respect to a middle part whose unworked or even final dimensions are imprecise.

Elastically suspending the movement in a watch case by means of an elastic ring made of rubber placed between the middle part and an inner metal ring intended to support the movement is known, in particular from French Patent No. 898 248. The rubber ring is pre-manufactured with predetermined dimensions, then inserted in the middle part, to which it is fixed using an adhesive material. It can thus be assembled to the ring by adhesion. This ring rests against the bezel and the back cover of the case to assure sealing and further includes a tubular lateral extension which acts as sealing gasket for the winding stem. However, a ring of this type having predetermined dimensions does not allow variations in the dimensions of the middle part to be compensated, or only very locally. Further, such compensation is not provided in the aforecited Patent.

SUMMARY OF THE INVENTION

An object of the present invention is to overcome the aforementioned problems, by providing a simple and economical manufacturing method, which allows proper accurate positioning of the movement in the middle part of the watch case and compensation of any variations in the dimensions of the middle part, in particular by avoiding machining operations of the interior of the middle part. Another object of the invention is to facilitate making of the means for sealing the watch case.

The invention therefore concerns a method of the type defined in the preamble, characterised in that at least a portion of the element made of elastomeric material is formed by moulding in a gap between the middle part and the support ring, during which step the support ring is held in a desired position within the middle part by means of at least one core which is positioned with respect to one or more reference surfaces of the middle part.

The elastomeric nature of the material moulded in the gap between the support ring and the middle part allows one to be free of previously very strict constraints, as regards shape and machining to the desired dimensions within the middle part. In fact, no machining of the interior of the middle part is necessary on the surfaces which will be covered with the elastomeric material, and it is even advantageous for these surfaces to be rough or unworked, which improves adherence. The outer dimensions of the support ring pose fewer problems, since this part is generally machined if it is made of metal, or moulded with sufficient accuracy if it is made of plastic material.

An important aspect of the invention is that the support ring, in particular when it is a casing ring, does not need to be positioned by resting against inner surfaces of the middle part, in particular the surfaces which will be in contact with the elastomer. This allows other locations to be selected as reference surfaces for positioning of the support ring, for example outer surfaces of the middle part which would have in any case to be machined or polished, or surfaces which determine the external appearance of the watch, such as the snap for the crystal or back cover.

The element made of elastomeric material is preferably overmoulded in said gap by injection, transfer or compression. This element may include at least one portion which is set in place after the overmoulding step.

The element made of elastomeric material can constitute a sealing gasket between the middle part and the back cover of the case, and/or between the middle part and a control stem passing through the middle part, and/or between the middle part and a crystal of the case.

The overmoulded elastomeric material is preferably selected so that it adheres to the material of which the middle part is made.

BRIEF DESCRIPTION OF THE DRAWINGS

Other advantages of the invention will appear in the following description of two preferred embodiments, given here by way of non limiting example and illustrated by the annexed drawings, in which.

DESCRIPTION OF PREFERRED EMBODIMENTS

Figure 1:
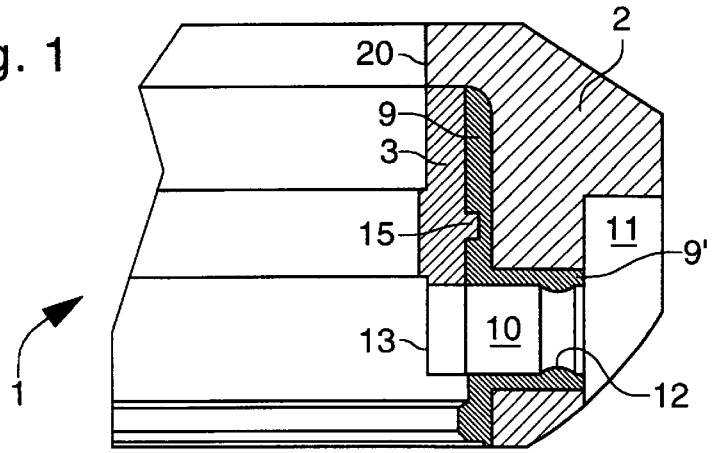
FIG. 1 is a partial cross-section of a portion of a watch case manufactured according to a first embodiment.
Figure 2:
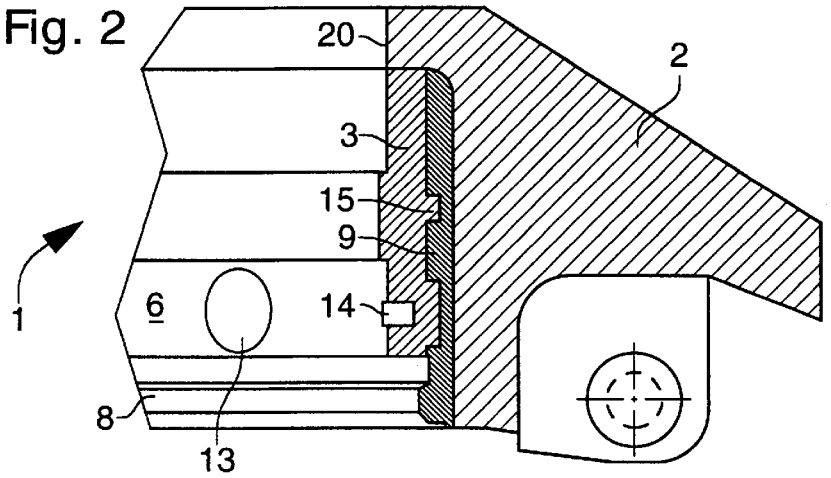
FIG. 2 is a similar view to FIG. 1, but at another location of the case.
Figure 3:
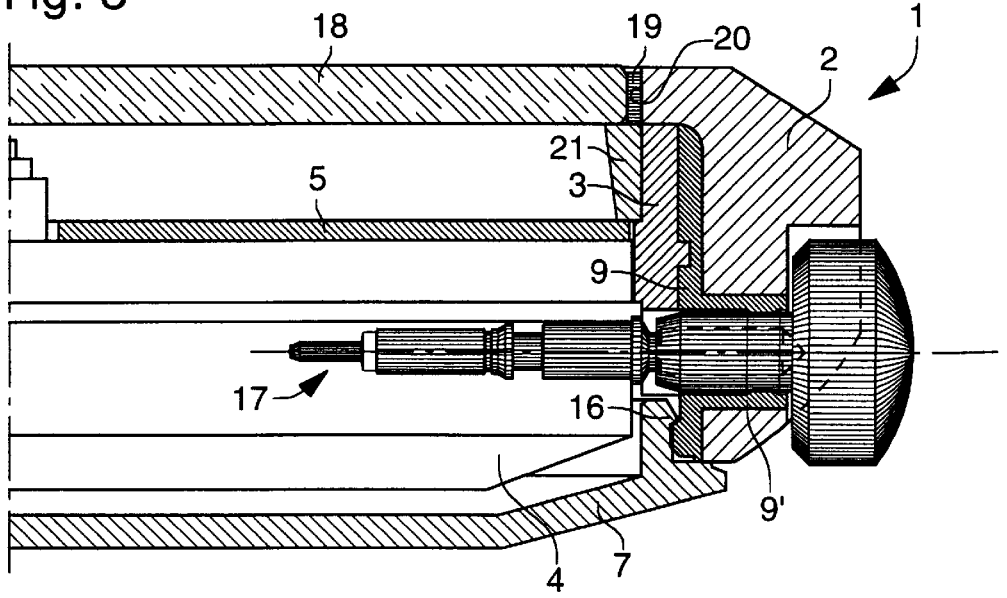
FIG. 3 is a similar view to FIG. 1, showing the whole case and the internal elements of the watch.

Watch case 1 shown in FIGS. 1 to 3 includes a middle part 2, a casing ring 3 and a back cover 7. A movement 4 and a dial 5 will be supported by casing ring 3. An element 9 made of overmoulded elastomeric material fills the entire gap between ring 3 and middle part 2 and extends, in a lateral hole of the middle part, via a tubular portion 9' the interior of which forms a housing 10 intended to accommodate the watch control stem 17. The element 9 made of elastomeric material is preferably overmoulded in said gap by injection, transfer or compression. The tubular portion has a circular sealing bulge 12 in housing 10. On the outer side, housing 10 opens into a crown recess 11 made in middle part 2.

FIG. 2 shows a cross-section offset angularly with respect to the cross-section of FIG. 1. This is why orifice 13 of housing 10 is outside the plane of the cross-section. FIG. 2 shows the location 6 of movement 4, as well as the location 8 of back cover 7. Ring 3 includes a cavity 14 intended to accommodate a catch of movement 4, this catch being intended to fix movement 4 to ring 3.

FIGS. 1 and 2 show a shoulder 15 of ring 3, embedded in elastomeric element 9. This shoulder fixes ring 3 and element 9 to each other after overmoulding.

It can be seen that elastomeric element 9, in FIG. 3 forms the sealing between back cover 7 and middle part 2 as well as between the middle part and control stem 17, thanks to bulge 12. Back cover 7 is fixed by snap fitting onto the lower portion of elastomeric element 9, as a result of a catch 16, which assures a water resistant assembly.

Figure 5:
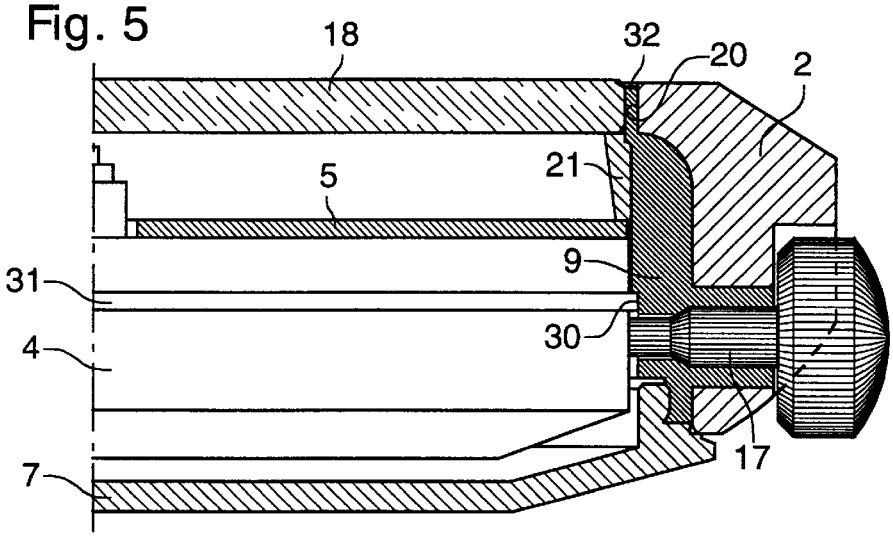
FIG. 5 is a similar view to FIG. 3, showing a second embodiment.

The sealing of crystal 18 is achieved, in the example described, by a sealing gasket 19 which is distinct from elastomeric element 9 and compressed between the edge of the crystal and a cylindrical surface 20 of the middle part, called the crystal snap. However, one could very well envisage that elastomeric element 9 has a shape extending upwards, behind a flange 21 placed above dial 5 as shown in FIG. 5, to constitute a gasket assuring the sealing between crystal 18 and middle part 2.

Figure 4:
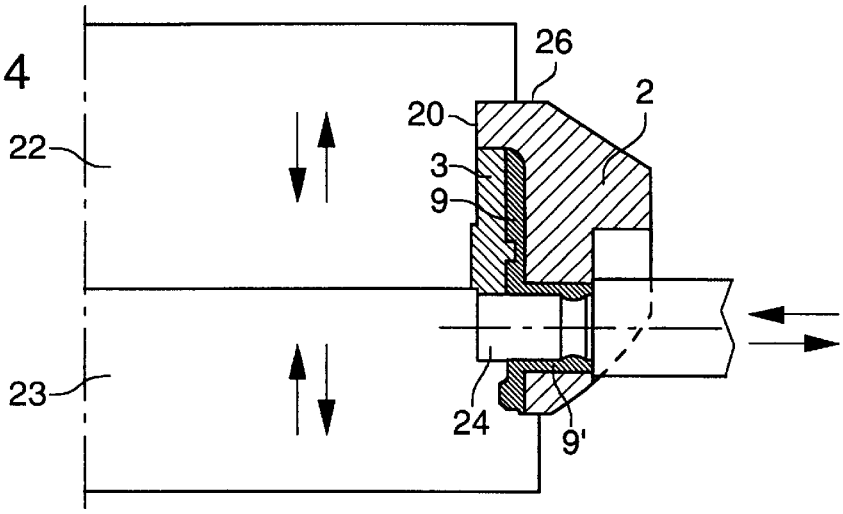
FIG. 4 is a similar view to FIG. 1, schematically illustrating the overmoulding operation via injection of elastomeric material.

Reference will be made to FIG. 4 to describe the overmoulding by injection step which allows elastomeric element 9 to be formed. The surfaces of middle part 2 and casing ring 3 onto which the elastomer will be applied are preferably previously coated with a primer able to stimulate adhesion of the elastomer. Middle part 2 is placed in a mould whose fixed portion (not shown) perfectly supports the exterior of the middle part, in order to prevent it busting under the injection pressure, which can reach very high values. FIG. 4 shows three mobile parts of the mould, namely an upper core 22 engaging in ring 3 to hold it in position, a lower core 23 intended to mould the lower portion of elastomeric element 9, and a mould slide 24 intended to form housing 10 in tubular portion 9'. Mould slide 24 can be coated with a, primer preventing it from adhering to the elastomer. Elements 22 to 24 are mobile in the directions indicated by the arrows. The elastomer is injected in a known way through cores 22 and/or 23, passage holes being arranged through ring 3.

Lateral positioning of ring 3 with respect to middle part 2 does not occur via resting on the middle part, but solely by means of upper core 22, guided by crystal snap 20 acting as reference surface on the middle part. An upper surface 26 of the middle part can act as height reference surface if necessary. Thus, casing ring 3 and all the elements which it carries, in particular the movement and the dial, will occupy exactly the desired position in the watch, in particular to be perfectly centred with respect to this opening independently of any inaccuracies in the inner shape of the middle part. The same is true of the position of the back cover, which will be defined by the lower portion of element 9, moulded by means of lower core 23 which is guided in a conventional manner by upper core 22.

The lifting of the mould is performed in a conventional manner: mould slide 24 is removed outwards, lower core 23 is drawn downwards and upper core 22 is then withdrawn upwards.

The self-adhesive properties of elastomeric material 9 allowing it to fix ring 3 and middle part 2 perfectly to each other, removing the constraints of the inner shape of such middle part. One can envisage that, in certain cases, it may by preferable to form elastomeric element 9 by assembling various elements, each coming into a portion of the gap between ring 3, middle part 2, housing 10 and possibly back cover 7. For example, tubular portion 9' could be made beforehand, either by overmoulding, or pre-manufactured and fixed in the hole of the middle part prior to the overmoulding step.

Figure 6:
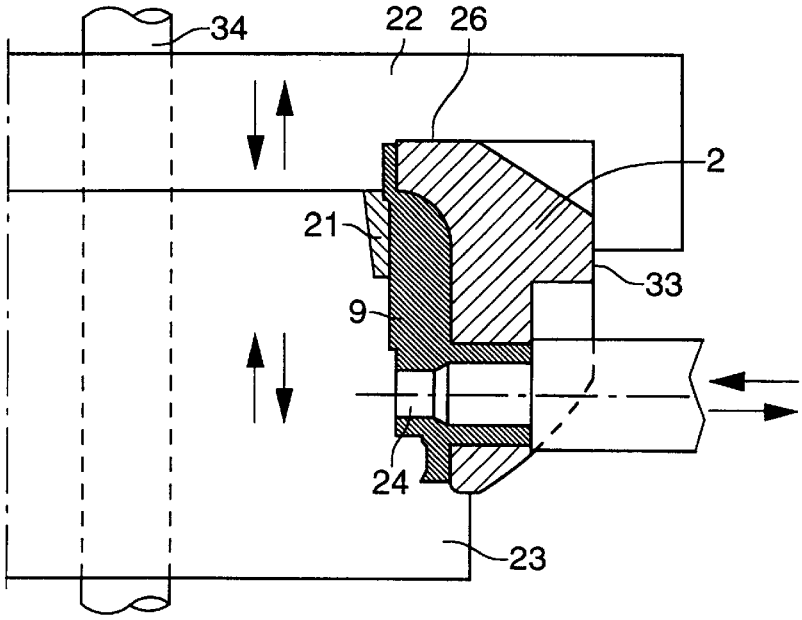
FIG. 6 illustrates schematically the overmoulding step in the second embodiment.

FIGS. 5 and 6 show a second embodiment of the invention, of which only the differences with respect to the first embodiment will be described. In this case, elastomeric element 9 is moulded between middle part 2 and a support ring formed here by flange 21. Element 9 also fulfils the function of a casing ring, since its inner surface obtains via moulding a precise position and dimensions, independently of any inaccuracies in the interior of the middle part. In order to position movement 4, element 9 has an inner shoulder 30 in which an outer flange 31 of the movement is placed.

As mentioned hereinbefore, elastomeric element 9 extends upwards to form, along crystal snap 20, a sealing gasket 32 between crystal 18 and the middle part.

FIG. 6 shows schematically that elastomeric element 9 shown in FIG. 5 is moulded in a similar way to that described with reference to FIG. 4, but in this case the guiding of cores 22 and 23 is slightly different. In order to assure perfect lateral positioning, and in particular centring of flange 21 and the inner surface of element 9, upper core 22 is guided laterally on the strip of the middle part, i.e. the peripheral surface of middle part 2, acting as reference surface 33. In a conventional manner, lower core 23 is guided with respect to upper core 22 by vertical sliding, for example along shafts 34 passing through the two cores. Vertical positioning can be performed by resting on upper surface 26 of the middle part acting as reference surface.

In a variant of the second embodiment, one can also provide a casing ring, which is associated with flange 21 as in the case of FIG. 3, but shorter upwards or combined in a single part with the flange.

Those skilled in the art will have no difficulty in imagining other variants of the invention described here, without departing from the scope defined by the claims. In particular, the method described is also applicable in the case in which the back cover of the case is made in a single piece with the middle part, the movement being inserted in the case from the top.

The method according to the invention is applicable whatever the method for manufacturing the middle part and the other parts of the watch case. However, it is particularly advantageous when one can omit machining of the interior of the middle part. This is the case in particular when the latter is formed by moulding, for example by MIM (Metal Injection Moulding) or when it is made of ceramic material, hard metal or another material capable of being moulded.

What is claimed is:

1. A method for manufacturing a watch case including a middle part, a back cover and a support ring for supporting internal elements of the watch, said method comprising the steps of: manufacturing separately said support ring and said middle part;

placing said support ring within said middle part while maintaining a gap between them, said support ring being held in a desired position within said middle part by means of at least one core which is positioned with respect to one or more reference surfaces of said middle part;

forming at least a portion of an elastomeric element in said gap by moulding of an elastomeric material to fix said support ring in said desired position to the interior of said middle part via said elastomeric element.

2. Method according to claim 1, wherein the elastomeric element is overmoulded in said gap by a process selected from injection, transfer or compression.

3. Method according to claim 2, wherein the elastomeric element includes at least one portion which is set in place prior to the overmoulding step.

4. Method according to claim 1, wherein the elastomeric element constitutes a sealing gasket between the middle part and the back cover of the cases.

5. Method according to claim 1, wherein the elastomeric element constitutes a sealing gasket between the middle part and a control stem passing through the middle part.

6. Method according to claim 1, wherein the elastomeric element constitutes a sealing gasket between the middle part and a crystal of the case.

7. Method according to claim 2, wherein the overmoulded elastomeric material is selected so that it adheres to the material of which the middle part is made.

8. Method according to claim 1, wherein the support ring is a casing ring.

9. Method according to claim 1, wherein the support ring is made of plastic material.

10. Method according to claim 1, wherein the middle part is made of ceramic material or hard metal.

11. Method according to claim 1, wherein said reference surfaces are not in contact with the element made of elastomeric material.

12. Method according to claim 11, wherein the reference surfaces are outer surfaces of the middle part.

13. Watch case obtained by a method according to claim 1.

* * * * *